US005425182A

United States Patent [19]

Brunner

[11] Patent Number: 5,425,182

[45] Date of Patent: Jun. 20, 1995

[54] APPARATUS FOR DRYING WOOD AND OTHER SOLID MATERIAL

[76] Inventor: Reinhard Brunner, Vorwerkstr. 9, 30989 Gehrden, Germany

[21] Appl. No.: 136,565

[22] Filed: Oct. 13, 1993

[30] Foreign Application Priority Data

Oct. 14, 1992 [DE] Germany ..... 42 34 683.5

[51] Int. Cl.[6] ..... F26B 19/00

[52] U.S. Cl. ..... 34/66; 34/396; 34/62; 34/73

[58] Field of Search ..... 34/5, 15, 16.5, 92, 34/60, 62, 66, 67, 72, 73, 75, 201, 202, 391, 393, 396, 428, 429

[56] References Cited

U.S. PATENT DOCUMENTS

| | | | |
|---|---|---|---|
| 2,273,039 | 2/1942 | Hudson | 34/16.5 |
| 3,283,412 | 11/1966 | Farnsworth | 34/5 |
| 3,382,586 | 5/1968 | Lorentzen | 34/5 |
| 3,574,949 | 4/1971 | Farnsworth | 34/16.5 |
| 5,228,209 | 7/1993 | Brunner | 34/16.5 |

*Primary Examiner*—Denise L. Gromada
*Attorney, Agent, or Firm*—Emmanuel J. Lobato

[57] ABSTRACT

Apparatus for drying wood or other solid material has an elongate cylindrical vessel in which there is an elongate platform on which is placed the material to be dried. The platform divides the interior of the vessel into an upper drying chamber and a lower condensing chamber with restricted communication between the two chambers. In the drying chamber there is a heater and one or more fans for circulating the air and water vapor in the chamber. An air cooling channel of much greater width than height extends below the vessel for its full length and is formed between a lower part of the vessel and a spaced outer wall formed of sheet metal or plastic and preferably heat insulated. One or more fans in the base of a chimney at one end of the cooling channel produce variable and reversible flow of air through the cooling channel.

14 Claims, 1 Drawing Sheet

APPARATUS FOR DRYING WOOD AND OTHER SOLID MATERIAL

FIELD OF INVENTION

The invention relates to apparatus for drying wood and other solid material consisting of a vessel for vacuum operation in which there is installed a support for cut wood, a heating device and a circulating device for the drying medium, a condenser and a cooling air channel of which one wall is formed by a part of an outer wall of the vessel.

BACKGROUND OF THE INVENTION

Such apparatus is the subject of EP 0 505 586 A1. This apparatus dries wood by vacuum and represents a so-called vacuum dryer. This consists of a pressure-fight hermetically closable drying chamber with a connected vacuum pump, has a support for the cut wood, is provided with a heating device and a circulating device for the gaseous drying medium and has, in the interior of the vessel, a condenser which is wholly or partially formed through a part of the chamber wall which is cooled by a cooling channel lying outside the vessel so that that part of the chamber wall functions as a condenser. The cooling channel thereby serves to carry off the condensation heat, which is produced by condensation of water in the form of water vapor upon its condensation on the condenser which is cooled to a temperature below the point of condensation.

In this publication, the vessel has no insulation on the portion below a partition of separating the condensation space from the drying space but has laterally arranged ventilators which circulate cooling air transversely to the axial direction of the vessel. As the length of the vessel is usually much greater than its width, it is necessary, in order to provide effective cooling, to provide a plurality of blowers arranged along a line parallel to the axis of the vessel in order to provide effective cooling. The cost and arrangement of so many blowers is expensive.

The energy requirements for driving such a large number of blowers makes the cost of drying wood excessive. By reason of the short distance which the cooling air travels with the known arrangement of blowers, relatively little heat is carded off per volume of cooling air.

This disadvantage is partially avoided through another arrangement of a vacuum dryer described in DE-OS 42 08 913. This publication shows a cooling air channel which is defined by the vessel outer wall and the foundation, which extends in the axial direction of the vessel and contains cool air ventilators in the channel below the vessel. In this manner the need of a large number of blowers is avoided. This embodiment has, in particular, with a long vessel, the disadvantage of high foundation cost. Moreover, because of the relatively great height of the channel, which is greater than the diameter of the ventilator, the electrical energy required for the ventilator motor is not well utilized since an essential part of the conveyed air does not come in contact with the vessel wall and therefore does not contribute to cooling.

However, not only is the condenser to be cooled but also other components, in particular the vacuum pump or its parts. The energy for cooling the vacuum pump or its parts is not so great because the vacuum pump is not constantly in operation but is switched on in particular at the beginning of the drying procedure. It is thus in operation when the vessel wall need not yet be cooled.

SUMMARY OF THE INVENTION

The present invention avoids the disadvantages of the state of the art. It is an object of invention with low equipment cost and with limited energy requirements to achieve exceptional cooling, in particular of the condenser.

The invention consists therein that the cooling channel extends axially over the greater part of the vessel in a lengthwise direction, that the air stream in the cooling air channel flows in a direction lengthwise of the vessel and that the effective channel width is greater than the channel height.

Through this design there is attained a large heat exchange surface relative to the volume of the cooling channel. According to the vessel length, one or two ventilators are sufficient. When, for a given channel width, the height of the channel and thereby also its cross section, is reduced, the velocity of the air in the channel, with equal conveying capacity of the ventilators, is correspondingly increased. Now the amount of heat which is transferred with a given temperature difference per unit time and surface area of a fixed body in a flowing medium (known as the heat-transfer coefficient) is to a great extent proportional to the velocity of the stream. It follows that when a channel height which is small with respect to the channel width (i.e., the length of the arc of the channel) is selected, effective cooling of the condenser with less air is achieved. However, the height of the channel cannot be reduced to zero since the flow resistance of the channel becomes too great without the stream velocity further increasing. The amount of air transported per unit time, i.e., the heat absorbing capacity of such an amount of air, must be sufficient to absorb the required amount of heat before reaching the temperature of the vessel. In practical design, according to to the length and diameter of the drying vessel, as well as according to the cross section of the installed ventilator, the channel height is selected between 2 cm and 15 cm. The exact selection of the height of the channel within these limits depends primarily on the kind and size of the material to be dried, namely, the favorable speed of drying for this material through which the necessary cooling capacity is provided.

In accordance with that intention, a channel height is selected which is so small that the air conveyed in the channel reaches a sufficiently high velocity and all parts of the air volume come into contact with the vessel wall in their travel through the channel, while the channel cross section is, however, sufficiently large that the air volume conveyed per unit time is sufficient in order to carry away the condensation heat according to the speed of drying.

It is advantageous when the cooling channel in its length, preferably at its ends, is widened and these widened portions contain ventilators for conveying the cooling air. It is hereby achieved that high-output blowers of the usual design can be installed in order to forward the cooling air through the very flat channel.

It is advantageous when the end portions of the cooling channel, which extend beyond the ends of the vessel, are closed by a vertical wall in which openings provide orifices in which ventilators for forwarding the cooling air can be mounted in a simple manner.

The ventilators can be axial or radial fans or blowers.

At opposite ends of the vessel, missing surfaces of the cooling channel can be replaced by a cover.

The production of the cooling channel is very simple and inexpensive when the outer wall of the cooling channel is formed of sheet metal or plastic.

It can be advantageous when the outer wall of the cooling channel is heat insulated or is formed of heat insulating material. It is hereby achieved that the cooling power with ventilators at rest is reduced to a small value when in the running drying phase, there occurs little or no demisting.

When, for example, for rapid drying of green wood with high outside temperature, an additional condenser with closed cooling circuit is used in the drying chamber with the flat heat exchanger of this additional condenser in the cooling channel, an additional cooling device can be avoided.

In order to reduce the current requirement for the cooling fans, it is advantageous when the cooling channel is connected with a chimney. For this, it is advantageous when the cooling channel is connected through ventilator openings for fans with a chimney having a height of at least three meters and having at its upper end an adjustable damper. With the damper open, the ascending air current in the chimney produces an air flow through the cooling channel even when the ventilators are not running. The strength of this air flow can be controlled by the position of the damper. A further function of the chimney is to dampen the noise of the cooling ventilators. For this purpose is it advantageous when the chimney is lined with sound-absorbing material. The same purpose can, for example, be obtained by a brick chimney. Thereby it is possible to operate the drying apparatus in the vicinity of residences since commercial drying is not interrupted at night, when the cost of electric current is less.

With especially long vessels it can be advantageous to exhaust the cooling air from both ends of the cool air channel and to provide in the region of the middle of the vessel an enlarged space in the cool air channel from which the used cool air can be exhausted, for example, through one or two chimneys.

The cooling requirements in vacuum drying relate also to the drive of the vacuum pump. A high-performance pump requires first a precooling in the intake region so that the partial pressure of the steam to be condensed can be reduced to the pressure required for the pump intake. Secondly, the heat of operation of the pump must be carded off so that a favorable operating temperature can be maintained. With larger pumps this is achieved by means of an external heat exchanger or through direct cooling with expensive fresh water. Thirdly, it is necessary to cool the electric motor of the pump in order to reduce wear and increase the life of the pump. It is therefore advantageous when the vacuum pump, or a part of the vacuum pump, preferably the intake, a heat exchanger and/or the motor are accommodating in the cooling channel. The cost of an additional cooling device for the vacuum pump is thereby avoided. The intake pipe between the drying vessel and the pump is led through the cooling channel, the pump being assembled so that the required air stream flows over the pump motor and the heat exchanger of the pump cooling circuit is arranged in an appropriate place in the cooling channel. An appropriate place is the chimney or the widened part of the cooling channel.

In order on the one hand to control the cooling power of the condenser and also the pump heat exchanger and, at the same time, to reduce the cost for electrical energy, it is advantageous to use speed regulated ventilators. A controlled cooling of two independent systems with only a single blower control is possible because normally the two systems are not in operation at the same time. The vacuum pump is in operation only before the beginning of drying, during the evacuation of the drying chamber for a long period of time when the wood is not yet heated and there is no condensation. In the further process of drying, the pump comes into operation only for a relatively short period of time when the partial vacuum in the chamber falls below the desired value on account of a leak in the chamber or because of air entrained in the wood. The adjustment of the desired value of vapor partial pressure occurs above the condensation temperature and requires no operation of the pump.

When drying with relatively high temperatures and the cooling air along the length of the vessel is no longer sufficient to cool the pump, the introduction of reversible cooling ventilators is advantageous. By reversing the direction of rotation, it is achieved that cool fresh air is drawn in adjacent the vacuum pumps or their parts. The drawing in of fresh air can also be effected by the chimney.

The reversability has another advantage. When drying is effected with relatively high air partial pressure of the drying medium, spontaneous uniform diffusion of the water vapor in the drying chamber through the diffusion process is hindered. Wood piles which lie in the cooler condenser region on the air inlet side dry somewhat faster than the piles on the other side. Through reversing the air flow direction at suitable intervals, this effect is eliminated. There are also wood piles in the regions of the ends of the drying vessel which are subject to unequal drying when, for example, they are brought into the chamber with different moisture content.

BRIEF DESCRIPTION OF DRAWINGS

The essence of the invention will be more fully understood from the illustrated embodiment shown schematically in the drawings in which.

DESCRIPTION OF PREFERRED EMBODIMENT

Figure 1:
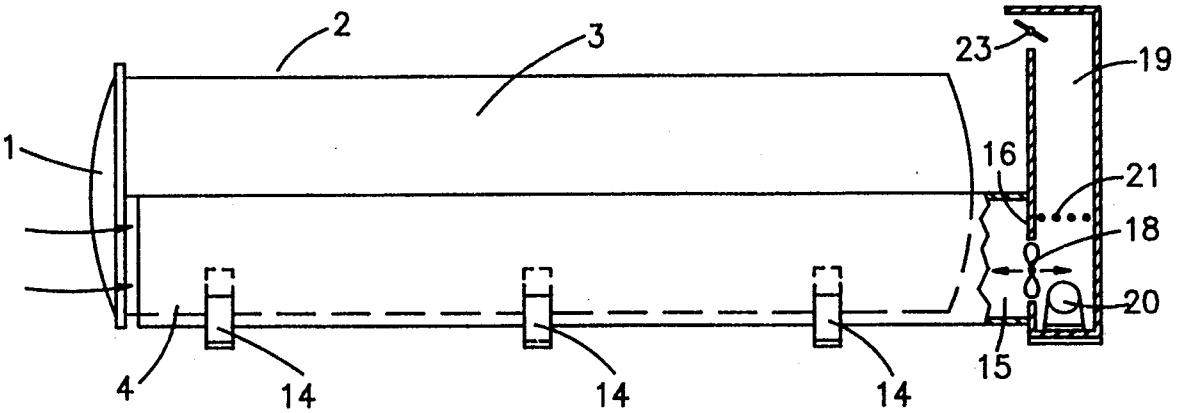
FIG. 1 is a side view of the drying apparatus.
Figure 3:
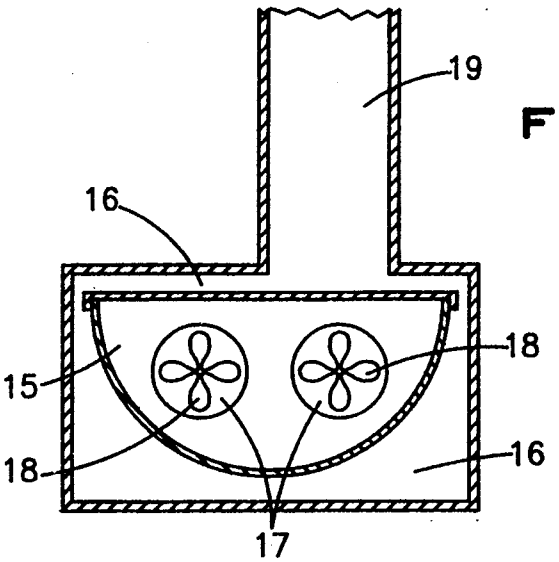
FIG. 3 is a cross sectional view showing the arrangement of ventilators in a widened part of the cool air channel.
Figure 2:
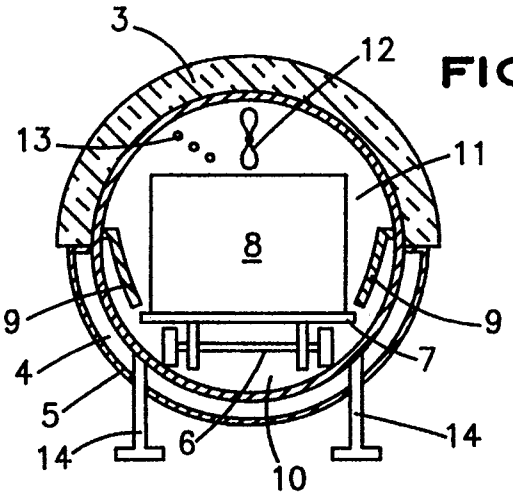
FIG. 2 is a cross sectional view through the vessel.

A cylindrical vessel 2 having at one end a hinged door 1 is provided on its upper side with heat insulation 3. The uninsulated lower part of the vessel has on its outer side a cooling channel 4 of which the width is very much greater than its height. This cooling channel is formed on one side through the lower noninsulated part of the wall of the vessel 2 and on the other side through a bottom or outer wall 5. The outer wall 5 is formed of sheet metal or plastic sheeting and is preferably heat-insulated. Running on tracks in the interior of the vessel is a carriage 6 having a load surface 7 on which the stacks 8 of the wood to be dried are supported. The load bearing surface 7 of the carriage 6 forms a part of a partition which is extended on both sides of the carriage 6 with the stacks of wood 8 through partitions 9 and which divides the interior of the vessel 2 into a lower condensation chamber 10 and and upper drying chamber 11. The condensation chamber 10 is thus formed by the load bearing surface 7, the partitions 9 and the uninsulated lower part of the wall of the vessel 2. The remaining part of the inner space of the vessel is the drying chamber 11 in which there are one or more ventilators or fans 12 for circulating air in the chamber. A heating device 13 is provided for heating air in the upper drying chamber 11. Through the ventilator or ventilators 12, a circular flow of the drying medium in the drying chamber is produced. Through the gaps between the wall of the vessel and the load bearing surface 7 and the partitions 9, water vapor continually flows from the drying chamber 11 into the condensation chamber 10 and is here condensed in the form of water on the lower part of the vessel wall. The vessel stands on feet 14 which are supported by a suitable foundation (not shown).

The cool air enters the cooling channel 4 at the end of the vessel provided with the door 1. The cooling channel extends to the end of the vessel opposite the door and terminates in a part 15 with enlarged cross section. The cooling channel is here terminated through a wall 16 having openings 17 in which fans or ventilators 18 are arranged. These forward the warmed cooling air into a chimney 19 in which the vacuum pump 20 and a heat exchanger 21 of the pump cooling cycle are accommodated. In the upper end portion of the chimney, there is an exhaust opening in which a variable damper 23 is accommodated.

What I claim is:

1. Apparatus for drying wood and other solid material comprising a closed elongate cylindrical vessel having an openable door at one end, a horizontal platform in said vessel for supporting material to be dried, said platform dividing the interior of said vessel into chambers comprising an upper drying chamber and a lower condensing chamber, said chambers being connected with one another through restricted connection permitting flow of air and water vapor from said drying chamber to said condensing chamber for condensation of water in said condensing chamber, heating means in said drying chamber for heating air and material therein, circulating means in said drying chamber for circulating air and water vapor in said drying chamber, an elongate cooling channel in communication to the atmosphere for receiving air for flow axially therethrough and extending axially below and exteriorly of said vessel and extending in a circumferential direction of the vessel, a lower wall of said vessel and a separate outer wall spaced downwardly and outwardly from said lower wall of said vessel defining said cooling channel, said cooling channel extending at least a major portion of the length of said vessel and having a height substantially less than an effective width dimension thereof in said circumferential direction of the vessel, thereby to obtain a large heat exchange surface on the vessel relative to the volume of the cooling channel and to maintain a cross section of the cooling channel effective for selectively developing velocity of an air flow therethrough effectively cooling said lower condensing chamber, and means for developing flow of air in said cooling channel in a direction lengthwise of said vessel.

2. Apparatus according to claim 1 in which one portion of said cooling channel is widened and in which said air flow producing means is in said widened portion of said cooling channel.

3. Apparatus according to claim 1, in which said outer wall portion of said cooling channel is formed of sheet metal.

4. Apparatus according to claim 1, in which outer wall portion of said cooling channel is formed of plastic material.

5. Apparatus according to claim 1, in which said outer wall portion of said cooling channel comprises heat insulating material.

6. Apparatus according to claim 1, in which said cooling channel is in heat transferring relation with said condensing chamber in said vessel and a heat exchanger is housed in said cooling channel.

7. Apparatus according to claim 1, in which said cooling channel has an end portion which extends beyond an end of said vessel opposite to said end having said door and in which a chimney extends upwardly from said end portion of said cooling channel.

8. Apparatus according to claim 7, in which said chimney has an outlet at its upper end and a variable damper located in said outlet.

9. Apparatus according to claim 7, further comprising a vacuum pump for evacuating said drying chamber and a heat exchanger for cooling said vacuum pump, said heat exchanger being accommodated in said chimney.

10. Apparatus according to claim 7, in which said means for developing air flow in said cooling channel comprises at least one fan in a lower portion of said chimney.

11. Apparatus according to claim 1, further comprising means for varying the rate of flow of air in said cooling channel.

12. Apparatus according to claim 1, further comprising means for reversing the direction of flow of air in said cooling channel.

13. Apparatus according to claim 1, further comprising partitions extending from side portions of said platform to side walls of said vessel.

14. Apparatus according to claim 13, in which said partitions extend upwardly and outwardly from said side portions of said platform.

* * * * *